United States Patent [19]

Fujieda et al.

[11] Patent Number: 4,787,410

[45] Date of Patent: Nov. 29, 1988

[54] GAS SHUT-OFF SYSTEM

[75] Inventors: Hiroshi Fujieda, Kashihara; Tatsuo Saka; Takashi Uno, both of Nara, all of Japan

[73] Assignee: Matsushita Electric Industrial Co., Ltd., Osaka, Japan

[21] Appl. No.: 878,990

[22] PCT Filed: Oct. 11, 1984

[86] PCT No.: PCT/JP84/00477

§ 371 Date: Jun. 9, 1986

§ 102(e) Date: Jun. 9, 1986

[87] PCT Pub. No.: WO86/02431

PCT Pub. Date: Apr. 24, 1986

[51] Int. Cl.[4] ..... F16K 17/36

[52] U.S. Cl. ..... 137/78.4; 137/554

[58] Field of Search ..... 137/78.4, 551, 552, 137/554

[56] References Cited

U.S. PATENT DOCUMENTS

| | | | |
|---|---|---|---|
| 3,307,613 | 3/1967 | Rexer | 137/78.4 X |
| 3,955,186 | 5/1976 | Green et al. | 137/78.4 |
| 4,262,687 | 4/1981 | Kobayashi | 137/78.4 X |

FOREIGN PATENT DOCUMENTS

| | | | |
|---|---|---|---|
| 0129973 | 8/1982 | Japan | 137/78.4 |
| 0144365 | 9/1982 | Japan | 137/78.4 |
| 85130 | 5/1983 | Japan . | |
| 110986 | 6/1984 | Japan | 137/554 |

*Primary Examiner*—John Rivell

*Attorney, Agent, or Firm*—Lowe, Price, LeBlanc, Becker & Shur

[57] ABSTRACT

This gas shut-off system includes a flow rate sensor (2) for detecting a gas flow rate and a control unit having a miocrocomputer (6) which determines abnormal states such as gas leak when a predetermined flow rate continuously keeps over a predetermined time period and automatically closes a shut-off valve (4) in accordance with the determination. A battery (13) is employed as a power-source for the microcomputer (16) and the shut-off valve (4). In order that the consumption amount of the battery (13) is reduced as small as possible, the microcomputer has a standby function and is set to the standby condition except gas flow rate computation and so on until the shut-off valve (4) is opened after set to the shut-off condition. An indicating device for indicating various states of the system comprises a light emitting diode (19) which is single indicator, so that power consumption is reduced.

5 Claims, 7 Drawing Sheets

GAS SHUT-OFF SYSTEM

TECHNICAL FIELD

The present invention relates to a gas shut-off system for prevention of explosive accidents caused by town gas, liquefied petroleum gas, and the like, and in particular to a gas shut-off system comprising a control unit including a microcomputer whereby a shut-off valve is automatically closed in response to detection of abnormal conditions such as gas leak which is made by the aid of a gas flow rate sensor, and using a battery as a power supply.

TECHNICAL BACKGROUND

Town gas and LP gas are being widely used as an energy source for cooking, heating, hot-water supply, or the like. However, if there is any failure of handling, these gases explode and cause a great accident. On the other hand, recently high altitude and airtight houses have caused the neighborhood to suffer damage from the gas accident. Therefore, putting the safety provision and gas device for prevention of the gas accidents to practical use should be early achieved in view of social conditions.

For prevention of the gas accidents, fuse cocks, reinforced gas hoses, town gas alarm devices, shut-off systems associated with alarm devices, and the like have been hitherto employed. These have not been spread to existing houses because of troublesome installation and are not necessarily effective for explosive accidents with suicidal intent which account for most of the accidents.

Of the causes of gas accidents, short-time great amount discharge of raw gas resulting from the separation of a pipe from a gas cock or the intentional opening of a gas cock and abnormal heating or oxygen deficiency resulting from the forgetting of turning-off of gas equipment important factors for the accidents, the accidents with suicidal intent relating to the former.

In these accidents, the flow rate pattern such as that gas flow rate and continuous time of flow rate becomes abnormal as compared with the normal conditions. Therefore, it is possible to prevent a wide range of gas accident including the accident with suicidal intent by automatically shutting off the gas main when the gas flow rate pattern becomes abnormal. Furthermore, the installation can be improved by combining the system therefor with a gas meter.

The estimation of pattern of use, comparison with an abnormal pattern, and the like can be realized by means of a microcomputer.

DISCLOSURE OF THE INVENTION

An object of the present invention is particularly to provide a long-life use for a battery used as a power supply in a system for previously preventing explosive accidents caused by gas such as town gas and LP gas used as an energy source for cooking, heating, hot-water supply in a house. A gas shut-off system according to the present invention includes a microcomputer programmed in terms of, for example, explosive limit to shut off the discharging of gas before the occurrence of gas explosion by the computation based on gas flow rate and discharge time. Also included in view of workability is a battery as a power source. Therefore, a gas shut-off system according to the present invention is arranged to minimize the consumption of the battery and to provide a long-time use of the battery.

In this system, a gas flow rate is detected by a flow rate sensor, and a microcomputer determines whether the flow rate pattern is normal or abnormal on the basis of the detection of the gas flow rate and actuates a shut-off valve to shut off the gas in response to the determination of abnormality. This system has greater ability for prevention of accidents as compared with conventional gas-accident preventing countermeasures. In addition, the system is combined with the gas meter, resulting in making it easy to install into existing houses and improving the workability.

This system comprises a lithium battery having excellent long-time reliability as a power source, a flow rate sensor having a reed switch, an exclusive CMOS 4-bit 1-chip microcomputer in which the consumption of current is low, an indicator including a LED and having an excellent visibility, and a self-hold type shut-off valve which matches the characteristics of the lithium battery. The arrangement enables the system to be operated by one lithium battery over ten years.

The reason that a battery has been selected as a power source of this system is as follows. Namely, in the case of use of the commercial power, it is required to provide a power cord between a power line and a gas meter, resulting in complex work and unsuitability for existing houses. Furthermore, when the power cord is intentionally or accidentally cut or when the supply of power to this system is stopped due to service interruption and the like, this system becomes inoperative. Therefore, a system including a battery as a power source must be required.

However, the duration of service of the battery is limited and therefore it is required to exchange the battery with a new one when the voltage is dropped due to consumption. Period of the battery exchange as long as possible is desirable for user because of reduction of labor.

MOST PREFERRED EMBOIDMENTS OF THE INVENTION

An embodiment of the present invention will be hereinbelow described with reference to the drawings.

Figure 1:
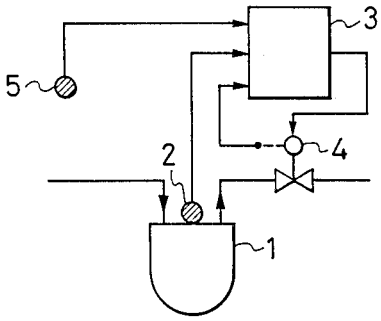
FIG. 1 is an illustration of a gas shut-off system according to an embodiment of the present invention.

A flow rate sensor 2 for measuring a flow rate is mounted on a gas meter 1 as shown in FIG. 1. A signal from the flow rate sensor 2 is applied to a control unit 3 for performing the determination of gas shut-off. The control unit 3 computes a gas flow rate and generates a gas shut-off signal when the gas flow rate meets predetermined conditions in terms of an abnormal flow rate. In response to the gas shut-off signal, a shut-off valve 4 provided in a gas passage is actuated to close the gas passage. Furthermore, the control unit 3 is responsive to signals from abnormality sensors such as earthquake sensor and CO sensor to generate the shut-off signal to shut off the gas passage when predetermined conditions are satisfied.

The control unit 3 includes a microcomputer programmed to effect the determination of the gas shut-off, the microcomuputer generating a shut-off signal to close the shut-off valve 4 when gas continuously flows for a predetermined time period. Namely, in the case of abnormally great flow rate, the shut-off signal is generated during a short time, whereas even if the flow rate is small, the determination of gas leak is made when the flow rate is not varied over a long time and the shut-off signal is generated, so that the discharge of gas is automatically stopped before reaching the explosive limit even if a closed space is filled with gas. This is effective for the abnormal condition that raw gas is continuously discharged with the cock of a gas device provided in a room being opened.

Furthermore, an earthquake sensor is effective as means for preventing the leak of raw gas and explosive accident caused by the damage of the gas passage provided at downstream of the gas meter 1 or the connecting portion between the gas passage and the gas device due to earthquake, while a CO sensor is effective as means for detecting the permeation of carbon monoxide (CO) in a room due to incomplete combustion of a gas apparatus. These sensors are provided as an abnormality sensor.

The microcomputer of the control unit 3 can be set to a standby mode. The standby mode means the condition that the microcomputer waits for a specific signal, i.e., interruption signal. When the signal is received in the condition, it returns to a normal operating condition (operating mode). Generally, current required when the microcomputer is in the standby mode is several percents of current required in the operating mode, the value of the current being small. The reason is that most of functions are stopped in the standby mode.

The control unit 3 receives an output of the flow rate sensor 2 arranged to count the reciprocating movements of the diaphragm of the gas meter and determines whether or not the gas flow rate periodically read is coincident with the gas aptitude use condition previously programmed. If the gas flow rate is coincident with the aptitude use condition, the measurement of flow rate is subsequently made. On the other hand, if it does not agree therewith because of abnormality, a gas shut-off signal is generated to shut off the shut-off valve 4. The comparison of the gas flow rate and the gas aptitude use condition is made for an extremely short time, and the microcomputer is in the standby mode except this comparison process, preventing excess battery consumption.

Figure 2:
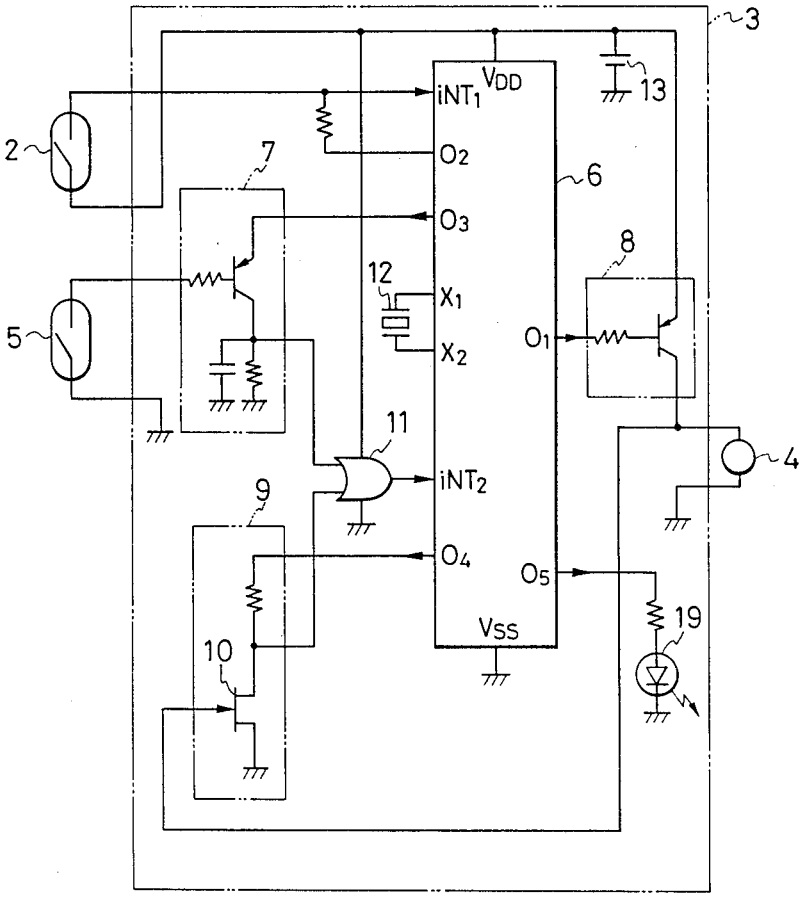
FIG. 2 is a detailed circuit diagram of FIG. 1 arrangement.

The circuit including the control unit 3 is shown in detail in FIG. 2.

A flow rate signal from the flow rate sensor 2 provided in the gas meter 1 is inputted through an interruption input terminal iNT1 to the microcomputer 6 of the control unit 3. A signal indicative of abnormality from the abnormality sensor 5 is supplied through an abnormality sensor processing circuit 7, an OR gate 11, and an interrupt input terminal iNT2 to the microcomputer 6. The abnormality sensor precessing circuit 7 comprises, for example, a chattering absorption circuit if the abnormality sensor 5 has a contact output. The shut-off output is applied from an output terminal $\bar{o}1$ through a shut-off valve driver 8 to the shut-off valve 4. The reference numeral 9 represents a return signal detecting circuit for detecting a return signal when the shut-off valve 4 is manually opened after the shut-off. Since a battery 13 is used as a system power source, a valve of one-shot self-hold type in which electromagnetic energy is not required for maintaining the the opening and closing conditions is employed as the shut-off valve 4.

In order that the shut-off valve 4 is of the one-shot self-hold type, for example, magnetic force of a permanent magnet is used for maintaining the shut-off valve 4 opening, and for setting the same to close a one-shot current is applied to an electromagnetic coil so as to generate the magnetic force having inverse polarity to the polarity of the permanent magnet and the shut-off valve 4 is set to the closed condition by means of both the electromagnetic force and the force of a spring and then maintained closed by spring force. Setting the same again to the opening condition is achieved by an external force such as manual force. At this time, the electromagnetic coil generates counter-electromotive force. Therefore, this counter-electromotive force developed across the electromagnetic coil of the shut-off valve can be used as the return signal. When this counter-electromotive force is applied to a junction type N channel FET 10 making up the return signal detecting circuit 10, this FET 10 becomes OFF during the time period that the counter-electromotive force is below cut-off voltage. The output of the return signal detecting circuit 9 is supplied through the OR circuit 11 and the input terminal iNT2 to the microcomputer 6 and therefore only one OR circuit 11 can be used as a logic circuit. The reference numeral 19 represents a light emitting diode which is one kind of indicators for indicating that the shut-off valve 4 is in the shut-off condition, only one diode being used. The light emitting diode 19 is controlled through an output terminal $\bar{o}5$ of the microcomputer 6.

The operation made in accordance with such an arrangement will be described hereinbelow.

When the shut-off valve 4 is set to the opening condition, the first output terminal $\bar{o}3$ of the microcomputer 6 is set to a high level and the abnormality sensor processing circuit 7 is in the operating condition, while the second output terminal $\bar{o}4$ is set to a low level and the return signal detecting circuit 9 is in the non-operating condition. In these conditions, only an abnormality signal of the abnormality sensor 5 is inputted through the abnormality sensor processing circuit 7 and the OR gate 11 to the input terminal iNT2. When the shut-off valve 4 is closed in response to the occurrence of abnormality, the first output terminal $\bar{o}3$ of the microcomputer 6 becomes low level and the second output terminal $\bar{o}4$ becomes high level, whereas the abnormality sensor processing circuit 7 is set to the non-operating condition and the return signal detecting circuit 9 is set to the operating condition. In response to the return of the shut-off valve 4, its electromagnetic coil generates a counter-electromotive force, and when the counter-electromotive force is less than the cut-off voltage of the FET 10, the FET 10 is set to the off condition and its drain voltage becomes high level which is in turn applied through the OR gate 11 to the input terminal iNT2.

Figure 3:
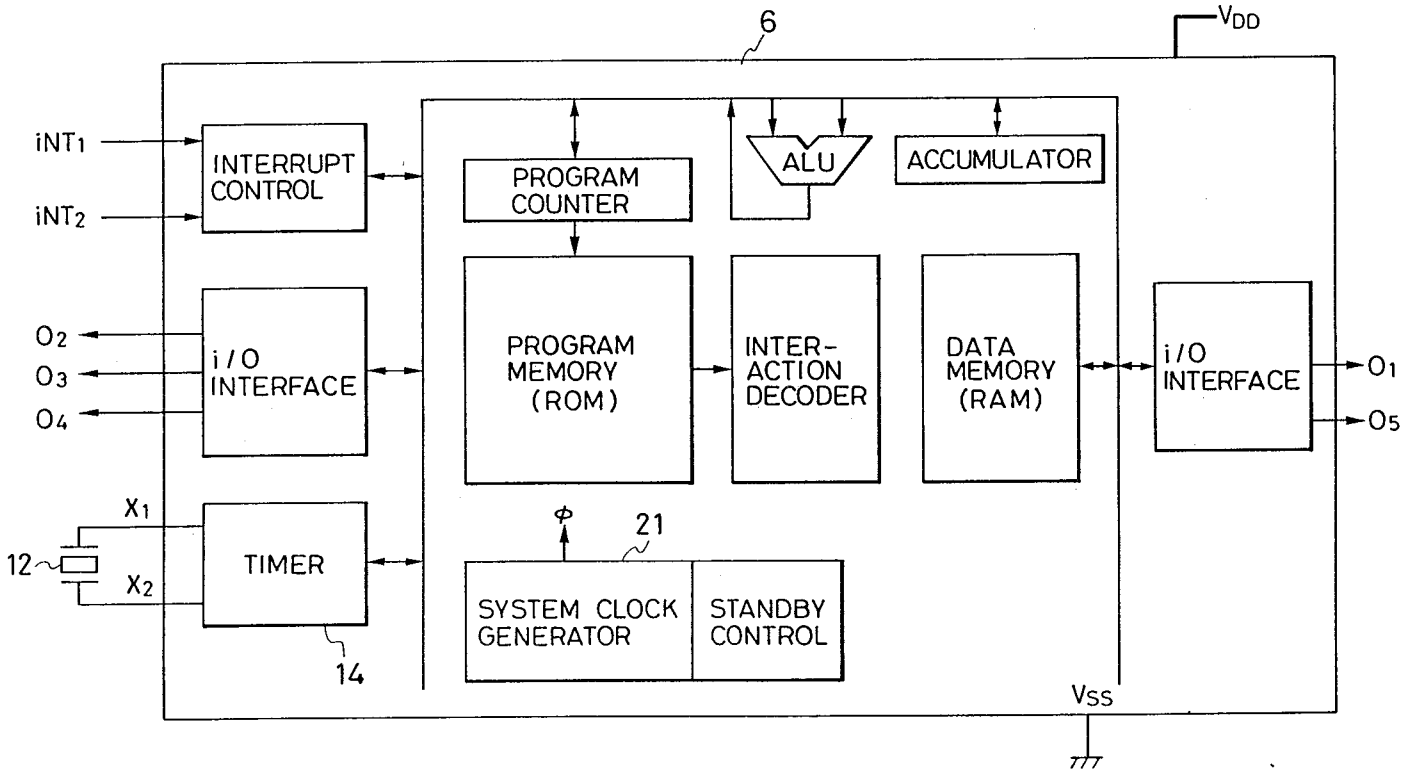
FIG. 3 is a diagram showing the microcomputer of FIG. 2 circuit.

FIG. 3 is an illustration of the arrangement of the microcomputer 6. The microcomputer 6 has a standby mode as described above and the standby control is performed as follows.

A stop command from a CPU stops the operation of a system clock generator 21, and therefore the system clock $\phi$ is stopped and the microcomputer 6 is set to the standby mode. Thereafter, in response to the application of an interrupt signal through the input terminal iNT2, the system clock generator 21 is again energized so that the microcomputer is returned to the operating mode. The power-supply current ($I_{DD}$) in the standby mode is several percents of the current consumed in the operating mode, this being very small.

A timer 14 comprises a generator for oscillating a crystal 12, a divider for dividing the frequency of the generator, and a counter for counting time-base signals produced by the divider.

Figure 4:
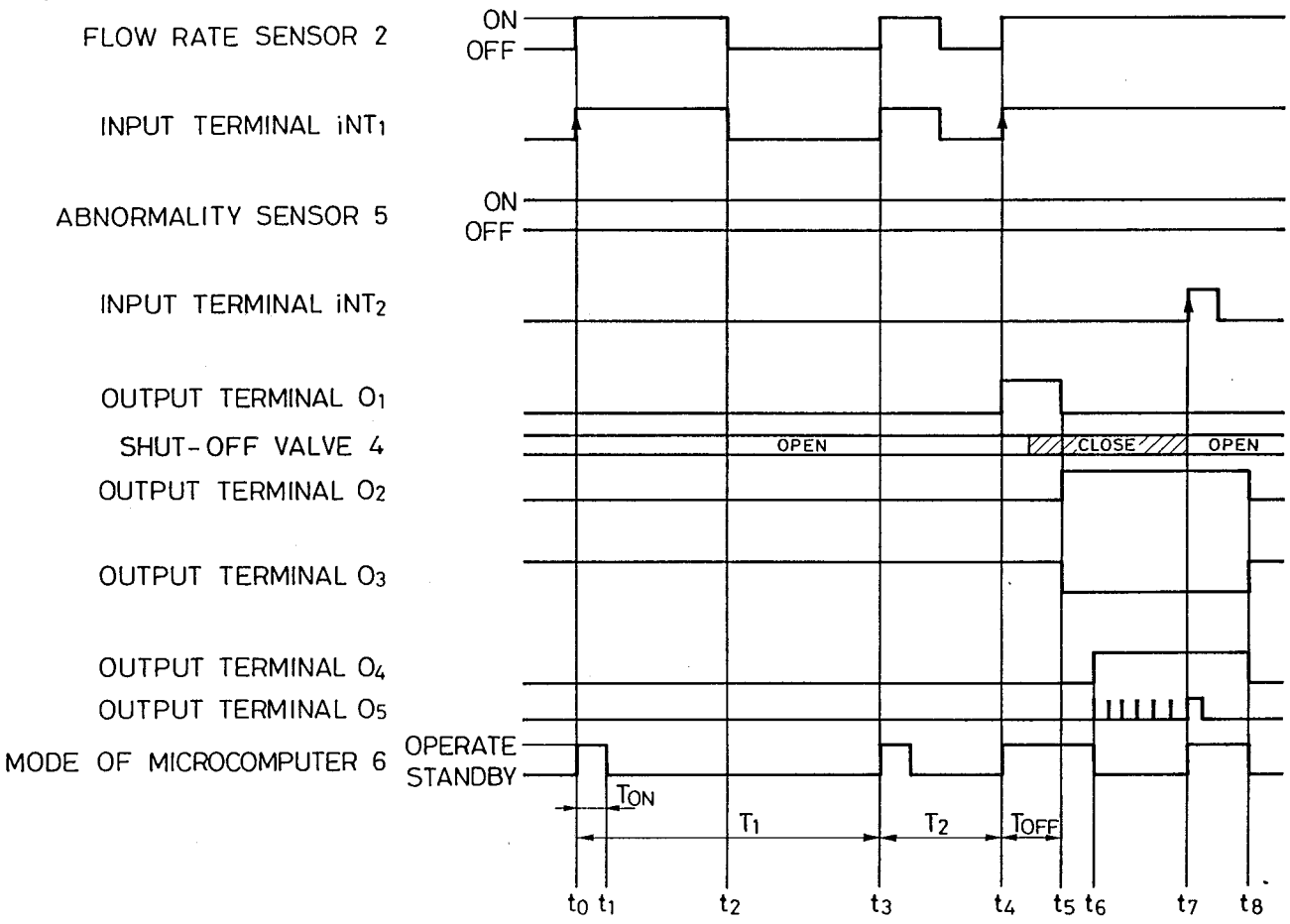
FIGS. 4 and 5 are wave form charts for understanding the operation of the circuit of FIG. 2.

FIG. 4 is a timing chart in terms of the circuit of FIG. 2. This timing chart represents the condition that the shut-off valve 4 is closed in response to the flow rate sensor 2 detcting that the gas flow becomes more than a predetermined flow rate.

Before a time t$\phi$, the shut-off valve 4 is not closed and therefore an output terminal $\bar{o}$2 of the microcomputer 6 is a low level (Lo) and the flow rate sensor 2 is set to the active condition. The output of the output terminal $\bar{o}$3 thereof is Hi, the output of the output terminal o4 is Lo, the abnormality sensor processing circuit 7 is set to the active condition, and the return signal detecting circuit 9 is set to the inhibited condition. These conditions are maintained until the shut-off of the shut-off valve 4.

In response to the flow of gas, the flow rate sensor 2 is turned on and off in accordance with the gas flow rate. When the flow rate sensor is turned on at the time t$\phi$, the input signal to the input terminal iNT1 of the microcomputer 6 is changed from Lo to Hi and the microcomputer 6 allows an interrupt to occur in response to the positive edge, and therefore the microcomputer is transferred from the standby mode to the operating mode. The microcomputer measures the time T$\phi$ between the previous iNT1 interrupt and the present interrupt by means of a timer and then compares the measured time T$\phi$ with a shut-off condition $T_F$ previously stored in a ROM. When $T\phi > T_F$, determination is made wherein the gas flow rate is small and no shut-off is performed. The timer 14 is again energized and "STOP" command is again executed to be set to standby mode. The above processes take a time $T_{ON}$, and hereafter similar operations will be effected whenever the input terminal iNT1 interrupt occurs. At a time t2, the flow rate sensor is set from on to off and the input of the input terminal iNT1 of the microcomputer 6 is varied from Hi to Lo. However, this negative edge results in no interrupt. At a time t3, the flow rate sensor is set from off to on and therefore interrupt occurs. Although the microcomputer 6 again makes the operating mode, because of $T1 > T_F$, it is further set to the standby condition. Thereafter, when the gas flow rate is abnormally increased, the on and off of the flow rate sensor 2 become shorter. This is detected by the microcomputer 6 set to the operating mode at a time t4. In this case, the determination is made as $T2 < T_F$ and therefore the microcomputer generates a shut-off signal through the output terminal $\bar{o}$1 by a time period $T_{OFF}$. When the generation of the shut-off signal is terminated at a time t5, the output of the output terminal $\bar{o}$2 is set to Hi, the output of the output terminal $\bar{o}$3 is set to Lo, the input terminal iNT1 input from the flow rate sensor 2 is set to inhibited condition, and the abnormality sensor processing circuit 7 is set to inhibited condition. After the termination of these processes, at a time t6, the outout terminal $\bar{o}$4 is set to Hi and the return signal detecting circuit 9 is set to the active condition. The reason that these processes is not performed at the time t5 but performed at the time t6 elapsed by an appropriate time from the time t5, is to prevent a counter-electromotive force (negative voltage) produced at the time t5 by the turning-off of current passing through the coil of the shut-off valve from being detected as a return signal. Thereafter, the microcomputer 6 is set to the standby mode and then waits for an interrupt input (iNT2) from the return signal detecting circuit 9.

When the shut-off valve is manually opened at a time t7, a counter-electromotive force (negative voltage) is developed in the coil of the shut-off valve. The FET 10 is turned off by the negative voltage and therefore a positive edge from Lo to Hi is inputted to the input terminal iNT2 of the microcomputer. Thereby, the microcomputer 6 is set to the operating mode, confirms that the shut-off valve 4 has been opened, and returns the outputs of the output terminals $\bar{o}$2, $\bar{o}$3, and $\bar{o}$4 to the conditions before the shut-off (before the time t4) at a time t8. Thereafter, the microcomputer 6 is set to the standby mode and waits for an interruption input (iNT1) from the flow rate sensor or an interrupt input (iNT2) from the abnormality sensor.

An output terminal $\bar{o}$5 of the microcomputer 6 generates a signal for turning on and off the light emitting diode 19 after the time t6, that is, when the shut-off valve 4 is set to the closed condition. The turning on and off mode is employed for reducing the consumption of the battery for indication. Namely, if the duty for the lighting is 1/100, the average current consumption also becomes 1/100. This can be easily realized by, for example, lighting it by 16 msec at intervals of 1.6 second. Such an indication is easily visible. When a return signal is inputted at the time t7, the microcomputer 6 outputs a lighting signal from the output terminal $\bar{o}$5 by a time period longer than the lighting time (for example, 1 sec in the case of the lighting time of 16 msec), so that the fact that the return signal is inputted to the microcomputer 6 is indicated to the exterior. This is performed to indicate that the return operation has been accurately effected.

Figure 5:
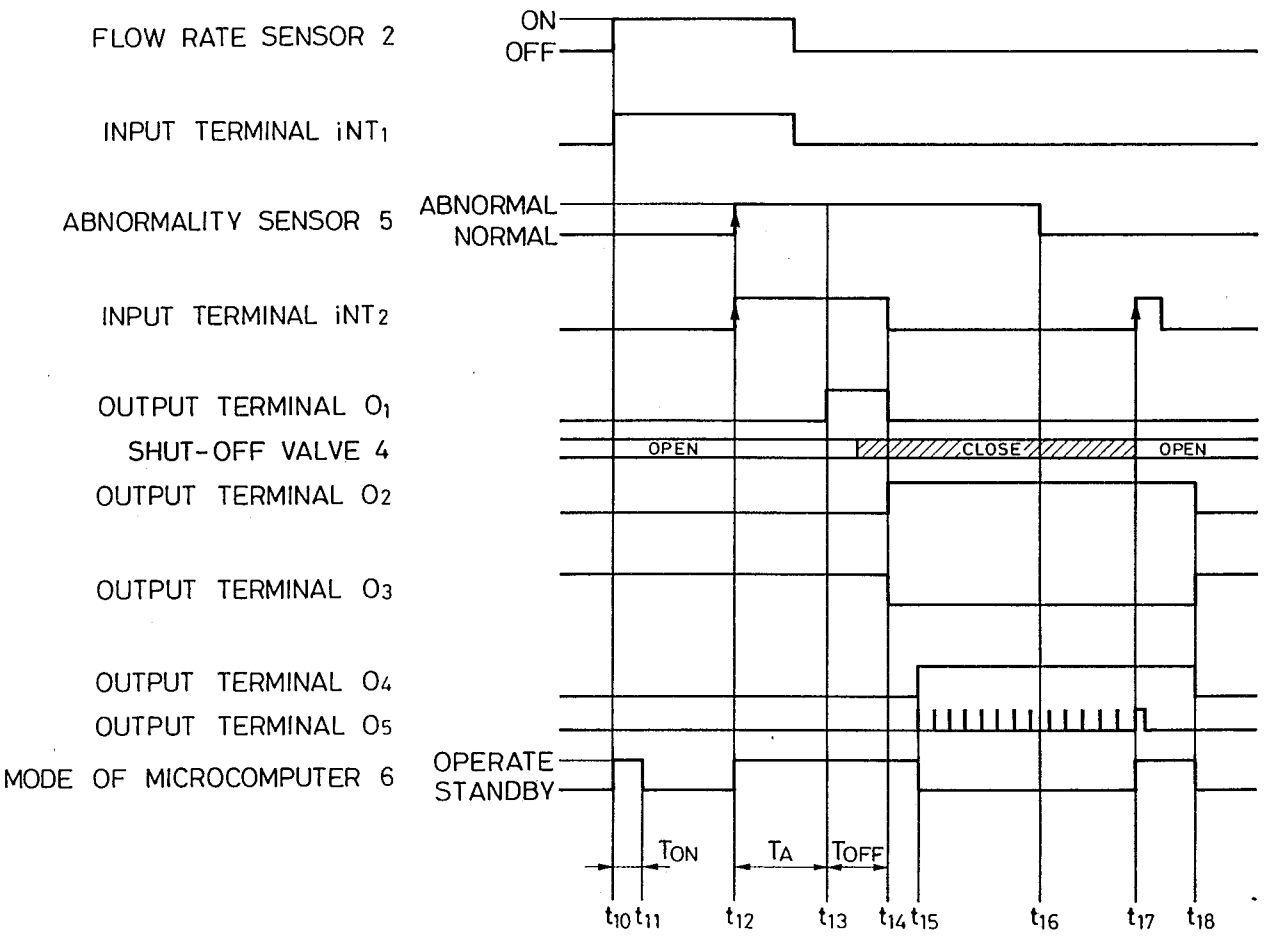

FIG. 5 is a timing chart for understanding the conditions that the abnormality sensor 5 of FIG. 2 circuit is energized.

When abnormality has been detected by the abnormality sensor 5, the detection signal is inputted as an interruption signal to the input terminal iNT2 (time 12). In this case, the microcomputer is set from the standby mode to the operating mode to check a signal supplied to the input terminal iNT2. The shut-off condition that the shut-off is performed when abnormal state is continued over a predetermined time $T_A$ is stored in a ROM of the microcomputer 6. At a time t13, since the abnormal state has been continued by the predetermined time $T_A$, the microcomputer 6 outputs a time $T_{OFF}$ shut-off signal from the output terminal $\bar{o}$1. The operations after the time 13 are similar to the operations after the time t4 in FIG. 4.

Figure 6:
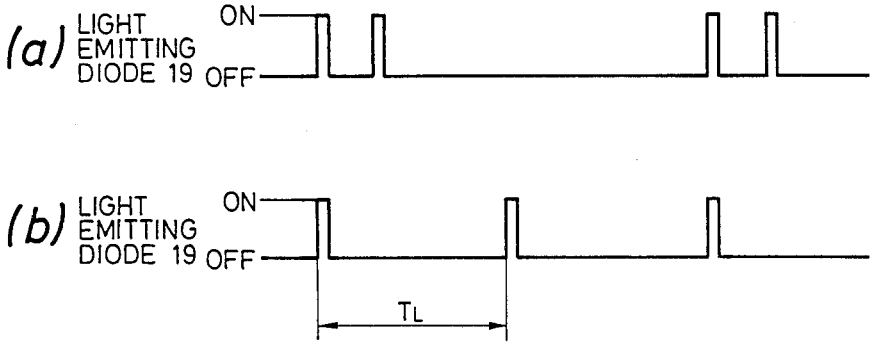
FIG. 6 is a wave form chart for understanding the operation of an indicator.

Here, a detailed description is made in terms of the indication by the light emitting diode 19. Only one light emitting diode is used for indicating the shut-off and return. The shut-off is indicated by turning on and off the diode, while the return of the shut-off valve is indicated by lighting the same for a long time. The shut-off, as indicated in FIGS. 3 and 4, is roughly divided into shut-off caused by flow rate and shut-off caused by the abnormality sensor. Because the shut-off cause is different, it is desirable that the shut-off cause can be estimated in accordance with the indication. Therefore, the turning-on and off pattern for indicating the shut-off condition is made as shown in FIG. 6, for example. In FIG. 6, the reference character a represents the turning on and off pattern of the shut-off caused by flow rate and character b designates the pattern of the shut-off caused by the abnormality sensors. Such variations of the turning-on and off pattern can be easily realized in accordance with the program of the microcomputer 6. In FIG. 6, in any cases, one lighting is performed at every period $T_L$ and the average currents required for the indication are equal to each other.

Now, a light emitting diode which has one package and enables to emit different two colors (generally, red and green) is available. If the diode is used, the output of the microcomputer 6 is increased by one and, in accordance with the pattern of FIG. 6*b*, when the shut-off is caused by flow rate, the indication can be made with green, and when it is caused by the abnormality sensor, the indication can be made with red.

With the shut-off valve 4 being opened, only when the flow rate sensor 2 is varied from off to on and the abnormality sensor 5 detects abnormality, the microcomputer 6 is set to the operating mode. Furthermore, even if it is in the operating condition, after the termination of predetermined processes, it is again returned to the standby mode. Therefore, the time period $T_S$ set to the standby mode is longer than the time period $T_{ON}$ set to the operating condition. The average current $I_{DD}$ is expressed as follows.

$$I_{DD} = \left(I_{DS} \cdot \frac{T_S}{T_S + T_{ON}}\right) + \left(I_{DR} \cdot \frac{T_{ON}}{T_S + T_{ON}}\right) \quad (1)$$

where:

$I_{DS}$=power-supply current in standby mode $I_{DR}$=power-supply current in operating mode For example, when $$T_S = 9T_{ON} \text{ and } I_{DS} = \frac{1}{10} I_{DR},$$

$$I_{DD} = \left(\frac{1}{10} I_{DR} \cdot \frac{9}{10}\right) + \frac{I_{DR}}{10} \approx \frac{I_{DR}}{5}$$

It will be seen from the above equation that the current $I_{DD}$ is about 1/5 as compared with $I_{DR}$ in the operating mode. Therefore, using the same battery, the operating time period becomes five times. Furthermore, the FET 10 of the return signal detecting circuit 9 is set to the on condition because the voltage between its drain and gate is zero, and current does not flow between its drain and source because the output of the output terminal $\overline{o}4$ is Lo, resulting in prevention of useless consumption. The reason is that it is not required to detect the return because the shut-off valve 4 is in the opening condition.

On the other hand, with the shut-off valve 4 being closed, the output of the output terminal $\overline{o}2$ of the microcomputer 6 is Hi and the output of the output terminal $\overline{o}3$ thereof is Lo, and therefore even if the flow rate sensor is turned on or the abnormality sensor 5 is set to abnormal condition, current does not flow through them, resulting in no uselessness.

In addition, because the light emitting diode 19 is turned on and off, it is possible to reduce the average consumed current as compared with lighting.

Figure 7:
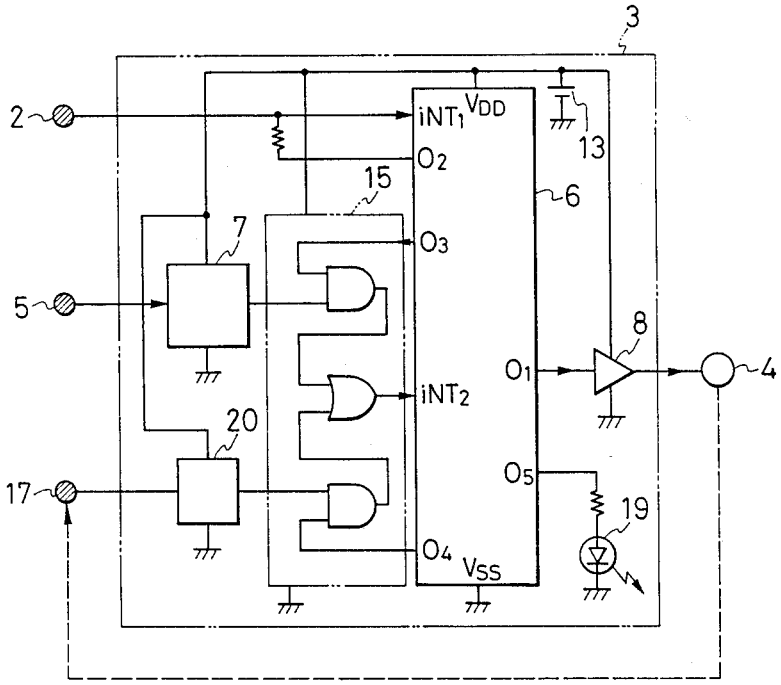
FIG. 7 is a diagram illustrating a gas shut-off system according to another embodiment of the present invention.

FIG. 7 illustrates another embodiment of the present invention. A logic circuit 15 receives a signal from the abnormality sensor 5 through the abnormality sensor processing circuit 7 when the shut-off valve 4 is opened and then inputs the signal through the input terminal iNT2 to the microcomputer 6. On the other hand, when the shut-off valve 4 is closed, a return signal from a return signal generating section 16 comprising a reed switch and so on is inputted through a return signal processing circuit 20 to the microcomputer 6. In the embodiment of FIG. 2, the outputs of the output terminals $\overline{o}3$, $\overline{o}4$ of the microcomputer 6 controls the abnormality sensor processing circuit 7 and the power supply of the return signal detecting circuit 9. However, in the embodiment of FIG. 6, the gate of the logic circuit 15 is controlled. That is, when the shut-off valve 4 is opened, the output of the output terminal $\overline{o}3$ of the microcomputer 6 is Hi, the output of the output terminal o4 thereof is Lo, an AND gate 15A is set to active condition, an AND gate 15B is set to inhibited condition, and the output of the abnormality sensor processing circuit 7 is inputted to the input terminal iNT2 of the microcomputer 6. Furthermore, when the shut-off valve 4 is closed, the outputs of the output terminals $\overline{o}3$, $\overline{o}4$ of the microcomputer 6 become inverse, the AND gate 15A is set to the inhibited condition, the AND gate 15B is set to the active condition, and the return signal is inputted to the input terminal iNT2.

Figure 8:
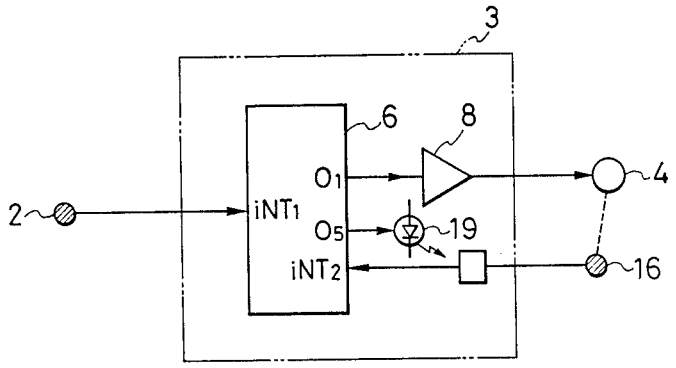
FIG. 8 is a diagram showing a gas shut-off system according to a further embodiment of the present invention.
Figure 9:
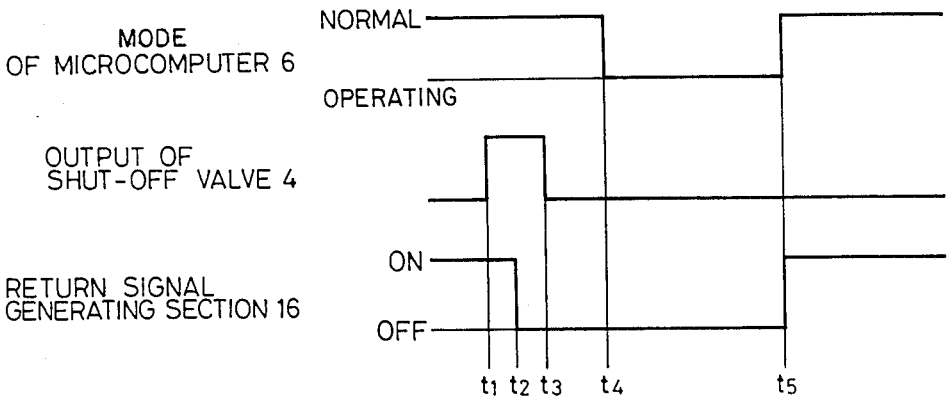
FIG. 9 is wave form chart for undestanding the operation of the system of FIG. 8.

A further embodiment of the present invention will be descrived with reference to FIG. 8. FIG. 8 arrangement does not include the above-described abnormality sensor 5. A control unit 3 includes a microcomputer 6 having a standby mode function. The microcomputer 6 is switched from the operating mode to the standby mode in accordance with a software. Here, The operating mode means the condition that the microcomputer 6 is normally operated, and in this case all functions are set to the operating conditions. On the other hand, since the functions are almost set to the stop condition in the standby mode, the consumed current is reduced to about several percents of that of the operating mode. After the microcomputer 6 is once set to the standby mode, it maintains the standby mode until a return signal from a return signal generating section 16 is inputted to its interrupt input terminal iNT2. In response to the input, the microcomputer is again set to the operating mode. Namely, as shown in FIG. 9, when the microcomputer 6 is in the operating mode, a shut-off signal is generated at a time t1. When the shut-off valve 4 is set to the closed condition at a time t2, the return signal generating section 16 is switched from on to off. When time goes to t3, that is, a predetermined time period is elapsed from the time t1, the generation of the shut-off signal is stopped. Thereafter, the microcomputer 6 is switched from the operating mode to the standby mode at a time t4. When the shut-off valve is set to the opened condition at a time t5, the return signal generating section 16 is set to on and a return signal is inputted to the interruption input terminal iNT2 of the microcomputer 6, and therefore the microcomputer 6 is again switched from the standby mode to the operating mode to start to read a signal from the flow rate sensor 2.

Figure 10:
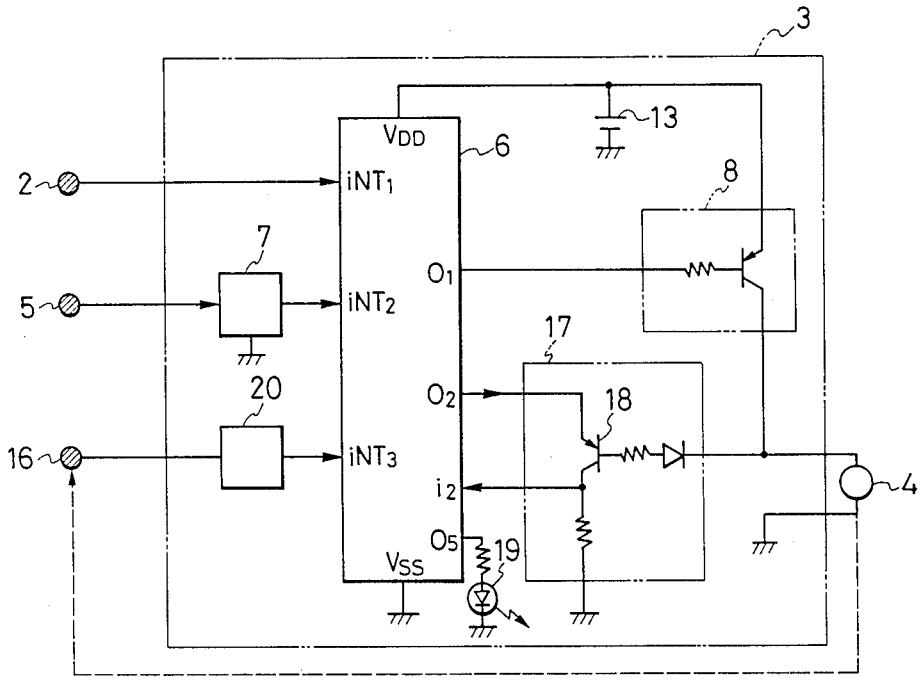
FIG. 10 is a diagram illustrating a gas shut-off system according to a still further embodiment of the present invention.

A still further embodiment of the present invention will be described with reference to FIG. 10. In FIG. 10 arrangement, the disconnection of the shut-off valve 4 can be detected.

In FIG. 10, the reference numeral 13 represents a battery and the on and off of a reed switch of a flow rate sensor 2 are converted into Hi and Lo voltage signals which are in turn inputted to the input terminal iNT1 of the microcomputer 6. Numeral 16 designates a return signal generating section (which uses a reed switch), and a return signal processing circuit 20 converts the on and off of the reed switch 16 into Hi and Lo voltage signals and inputs them to an input terminal iNT3 of the microcomputer 6. In the shut-off condition, the reed switch 16 is off and the output of the return signal processing circuit 20 is Lo. Numeral 17 represents a disconnection detecting section which has a transistor 18.

The microcomputer 6 receives a signal from the flow rate sensor 2, processes the signal in accordance with a predetermined process procedure, and checks whether or not the shut-off should be performed. If the shut-off condition is satisfied, a shut-off signal is outputted from the output terminal $\bar{o}1$ to a shut-off valve driver 8. In the process procedure, for example, it is performed to check whether or not the flow rate detected by the flow rate sensor 2 keeps a constant value over a predetermined time period. If it is over, the used time is longer than the normal use time of the equipment corresponding to the flow rate and such a condition is considered as an abnormality, and therefore a shut-off signal is outputted for a required time period. In the shut-off condition, since the reed switch 16 of the return signal generating section is off, the input terminal iNT3 is set to Lo. Next, when the shut-off valve 4 is manually opened, the reed switch 16 of the return signal generating section is turned on and the output of the return signal processing circuit 20 becomes Hi, and thereby the microcomputer 6 can know the fact that the shut-off valve 4 has been set to the opened condition. The Hi signal is outputted periodically (for example, every 24 hours) from the output terminal $\bar{o}2$ to energize the disconnection detecting section 17. This is performed using the internal timer 14 (FIG. 3) of the microcomputer 6. The output time period of the Hi signal is established so as not to operate the shut-off valve 4. When the output of the output terminal $\bar{o}2$ becomes Hi, voltage is applied to the emitter of the transistor 18. If the electromagentic coil of the shut-off valve 4 is normal without disconnection, a base current Ib flows so that the transistor 18 is turned on. Therefore, the collector voltage Ec of the transistor 18 becomes Hi and is inputted to an input terminal i2 of the microcomputer 6. The microcomputer 6 can check the presence or absence of the disconnection of the electromagnetic coil of the shut-off valve 4 by receiving the condition of the input terminal port i2 when Hi signal is outputted through the output terminal $\bar{o}2$. If the electromagnetic coil of the shut-off valve 4 is normal, the Hi signal is inputted. If there is a disconnection, the Lo signal is inputted. When disconnected, a turning-on-and-off signal is outputted from the microcomputer 6 to an indicating section (light emitting diode 19) to inform an user. In this case, the turning on and off period is shortened to make possible to easily distinguish this turning on and off indication from the turning on and off indication at the time of shut-off.

INDUSTRIAL APPLICABILITY

As understood from the above, the present invention relates to a system which is more for prevention of gas accidents such as gas explosion resulting from the separation of a rubber tube from a gas cock and the intentional opening of a gas cock and a fire and oxygen deficiency resulting from the forgetting of turning-off of gas equipment, as compared with conventional countermeasures.

Furthermore, the system is combined with a gas meter and uses a battery having long time reliability as a power source. Therefore, it is possible to maintain high reliability for a long time and to be employed for existing houses.

What is claimed is:

1. A gas shut-off system powered by a battery, comprising:

flow rate measuring means provided in a gas passage for measuring a gas flow rate therein to generate a signal indicative of the measured gas flow rate;

shut-off means provided in said gas passage to allow shutting off the flow of gas, said shut-off means generating a return signal when being set to the opening condition; and a control unit coupled to said flow rate measuring means and said shut-off means and arranged to assume an operating mode and a standby mode, said control unit having mode switching means whereby said control unit is allowed to be switched from said standby mode to said operating mode and storing data representative of a proper use condition of gas, said control unit determining a use state of gas on the basis of the flow rate signal from said flow rate measuring means and further determining an abnormality when the use state departs from the proper use condition and outputting a shut-off signal to said shut-off means in response to the determination of abnormality, said control unit switching by itself to said standby mode after the output of said shut-off signal and being then switched from said standby mode to said operating mode in response to an input of said return signal to said mode switching means.

2. A gas shut-off system as claimed in claim 1, further comprising indicating means for indicating a plurality of different states of the system with a plurality of turning-on-and-off patterns, said indicating means using one indicator, and said indicating means informs a state to the exterior with a first pattern indicated when a gas shut-off is performed and a second pattern indicated when said shut-off means is returned to the opening state.

3. A gas shut-off system as claimed in claim 1, further comprising an abnormality sensor for detecting abnormalities such as earthquake and discharge of CO gas and generating an abnormality signal in response to the detection, and wherein said control unit is responsive to said abnormality signal to generate said shut-off signal so that said shut-off means is set to the closing state to shut off the flow of the gas.

4. A shut-off system as claimed in claim 1, wherein said shut-off means comprises an electromagnetic coil, and further comprising disconnection detecting means for detecting a disconnection of said electromagnetic coil by flowing a current through said electromagnetic coil.

5. A shut-off system as claimed in claim 4, wherein a flowing time period of the current for the detection of the disconnection thereof is shortened as compared with that of said shut-off signal and the current is periodically supplied to said electromagnetic coil, and further indicating means for indicating the disconnection of said electromagnetic coil.

* * * * *